US009290992B2

(12) United States Patent
Fischer et al.

(10) Patent No.: US 9,290,992 B2
(45) Date of Patent: Mar. 22, 2016

(54) PLUG CONNECTION AND PIPE SECTION FOR A DRILL PIPE

(75) Inventors: Sebastian Fischer, Lennestadt (DE); Raimund Grobbel, Eslohe (DE)

(73) Assignee: TRACTO-TECHNIK GmbH & Co., KG, Lennestadt (DE)

( * ) Notice: Subject to any disclaimer, the term of this patent is extended or adjusted under 35 U.S.C. 154(b) by 926 days.

(21) Appl. No.: 13/369,791

(22) Filed: Feb. 9, 2012

(65) Prior Publication Data

US 2012/0205908 A1 Aug. 16, 2012

(30) Foreign Application Priority Data

Feb. 10, 2011 (DE) ..... 10 2011 010 958

(51) Int. Cl.

| | |
|---|---|
| ***E21B 17/046*** | (2006.01) |
| ***E21B 7/00*** | (2006.01) |
| ***E21B 17/02*** | (2006.01) |
| ***E21B 17/04*** | (2006.01) |

(52) U.S. Cl.

CPC ..... *E21B 7/002* (2013.01); *E21B 17/028* (2013.01); *E21B 17/04* (2013.01)

(58) Field of Classification Search

CPC ..... E21B 17/046; E21B 17/08; E21B 17/02

USPC ..... 166/242.1, 242.6, 380

See application file for complete search history.

(56) References Cited

U.S. PATENT DOCUMENTS

| | | | | |
|---|---|---|---|---|
| 2,257,101 | A | 9/1941 | Boynton | |
| 2,280,786 | A | 4/1942 | Boynton | |
| 2,551,995 | A * | 5/1951 | Brown | 175/255 |
| 4,454,922 | A | 6/1984 | Jamison et al. | |
| 5,682,956 | A | 11/1997 | Deken et al. | |
| 2004/0104052 | A1 * | 6/2004 | Livingstone | 175/61 |
| 2010/0260540 | A1 * | 10/2010 | Church | 403/305 |
| 2011/0168286 | A1 | 7/2011 | Koch et al. | |
| 2011/0200413 | A1 | 8/2011 | Hermes | |

FOREIGN PATENT DOCUMENTS

| | | |
|---|---|---|
| DE | 10 76 596 B | 3/1960 |
| DE | 10 2008 047 060 A1 | 3/2010 |
| EP | 0 817 901 B1 | 2/1996 |

* cited by examiner

*Primary Examiner* — Catherine Loikith

(74) *Attorney, Agent, or Firm* — Howard IP Law Group

(57) ABSTRACT

A plug connection for connecting two pipe sections of a drill pipe has a connecting plug on one end of a first of the pipe sections and a connecting bushing on one end of the second pipe section. The connecting plug and the connecting bushing have helical meshing guide projections and/or guide grooves. A pipe section for a drill pipe has on one of its ends a corresponding connecting plug and on the other end a corresponding connecting bushing.

17 Claims, 3 Drawing Sheets

PLUG CONNECTION AND PIPE SECTION FOR A DRILL PIPE

CROSS-REFERENCES TO RELATED APPLICATIONS

This application claims the priority of German Patent Application, Serial No. 10 2011 010 958.7, filed Feb. 10, 2011, pursuant to 35 U.S.C. 119(a)-(d), the content of which is incorporated herein by reference in its entirety as if fully set forth herein.

BACKGROUND OF THE INVENTION

The present invention relates to a plug connection for connecting two pipe sections of a drill pipe and a corresponding pipe section The following discussion of related art is provided to assist the reader in understanding the advantages of the invention, and is not to be construed as an admission that this related art is prior art to this invention.

When drilling in the soil with drill pipes, in particular for producing so-called horizontal boreholes which extend essentially parallel to the surface or have a relatively small slope angle with respect to the surface, a drill head is advanced by a drill pipe by a drive system arranged on the surface or in an excavation pit. The employed pipes consist of individual interconnected pipe sections which are sequentially added and connected to the rear end of the already installed pipe—commensurate with the drill path. Typically, threaded connections are used.

Boreholes are typically formed in soft soil through radial displacement and compaction of the soil. The drill head is therefore generally rotated only with a low rotation speed, if rotated at all, in addition to the static advance.

Conversely, for drilling through rock, i.e. drilling in rock or rocky soil formations, the rock needs to be crushed due to its insufficient deformability and to remove the crushed rock from the already produced borehole. Crushing the rock requires relatively high rotation speeds of the drill head which would cause considerable wear of the drill pipe, if the drill pipe would rotate in the borehole with the same rotation speed.

Essentially two different designs of rock drill systems, which operate without rapid rotation of the drill pipe that is in contact with the wall of the borehole, have come to dominate the market.

A first of these designs is based of the use of an in-hole motor which rotatably drives the drill head directly and not by way of the drill pipe. Instead, the assembly composed of the drill head and the in-hole motor is affixed on the front end of the drill pipe, with the drill pipe generating the axial pressure required for advancing the borehole. Because the rotation of the drill head required for creating the borehole is generated by the in-hole motor, the drill pipe itself in these drilling systems need not be rotatably driven. The wear of the drill pipe is therefore relatively small. So-called "mud-motors" are generally used as in-hole motors, with a drive fluid being routed through a turbine under high pressure to produce the rotation. This drive fluid is usually a drilling fluid which, after flowing through the mud motor, exits the borehole through outlet openings in the region of the drill head, in order to cool and lubricate the drill head and in order to wash out the removed cuttings through the annular space between the borehole wall and the drill pipe. Disadvantageously, these rock drilling systems based on in-hole motors not only consume a large quantity of drilling fluid, but also have low efficiency (e.g. 800 Nm when consuming 320 L/min of washing fluid).

The second commonly used design of rock drilling systems is based on using a double drill pipe. In these drilling systems, the drill head is additionally rotatably driven with the drive system arranged at the surface or in an excavation pit via an inner pipe of the double drill pipe. The drive system also advances the drill head. The inner pipe is hereby rotatably supported within an outer pipe of the double drill pipe. The outer pipe then does not rotate at all or rotates only at a low rotation speed. This type of rock drilling system also limits wear of the drill pipe, because the outer pipe contacting the rocky wall of the borehole does not rotate at all or only at a low rotation speed, whereas the inner pipe which is driven at a high rotation speed can be supported in the outer pipe to reduce wear.

In almost all conventional rock drilling systems employing double drill pipes, the individual pipe sections of the outer pipe and of the inner pipe are screwed together. This is, on one hand, quite time-consuming. On the other hand, large torques are transmitted at least via the inner pipe, causing severe "jamming" of the threaded connections (which operate in a self-locking fashion), so that the individual threaded connections need to be detached mechanically after the borehole is completed. This significantly increases the structural complexity of such rock drilling systems—in addition to the complex structure of the double drill pipe itself.

To reduce this time-consuming operation and to simplify the structure, a drilling system with a double drill pipe has been developed (see EP 0 817 901 B1), wherein the individual pipe sections of the inner pipe are no longer connected with each other by a screw connection, but are instead connected by a simple axial plug connection. For this purpose, each of the inner pipe sections has at one of its ends a connecting pin with a hexagonal cross-section and at the corresponding other end a matching connecting bushing, so that the two pipe sections can be readily connected with one another by inserting the connecting pin of one pipe section into the connecting bushing of the other pipe section. The axial plug connection allows a particularly simple and rapid connection of the individual pipe sections of the inner pipe. Disadvantageously, the two pipe sections must be exactly (rotationally) aligned before the two connecting parts can be plugged together, so as to overlap the two cross-sectional contours of the connecting pin and of the connecting bushing.

It would therefore be desirable and advantageous to obviate prior art shortcomings and to provide an improved plug connection for a drill pipe and in particular for the inner pipe of a double drill pipe.

SUMMARY OF THE INVENTION

According to one aspect of the present invention, a plug connection for connecting two pipe sections of a drill pipe includes a connecting plug disposed on one end of a first of the two pipe sections and comprising one of a helical guide protrusion or a guide groove, and a connecting bushing disposed on one end of the second pipe section and comprising one of a guide groove or a helical guide protrusion meshing with the helical guide protrusion or guide groove of the connecting plug.

According to another aspect of the present invention, a pipe section for a drill pipe includes a pipe section base body having two ends, with a connecting plug disposed on a first longitudinal-axial end of the pipe section base body and having one of a helical guide protrusion or a guide groove, and a connecting bushing disposed on a second longitudinal-axial end and having one of a guide groove or a helical guide protrusion constructed to mesh with the helical guide protrusion or guide groove of a connecting plug disposed on a pipe section base body of a second pipe section.

According to yet another aspect of the invention, a double pipe section for a double drill pipe has an outer pipe section and an inner pipe section arranged inside the outer pipe section, wherein the inner pipe section includes a pipe section base body having two ends, with a connecting plug disposed on a first longitudinal-axial end of the pipe section base body and having one of a helical guide protrusion or a guide groove, and a connecting bushing disposed on a second longitudinal-axial end and having one of a guide groove or a helical guide protrusion constructed to mesh with the helical guide protrusion or guide groove of a connecting plug disposed on a pipe section base body of a second inner pipe section.

The invention is based on the concept to allow a connection between two pipe sections of a drill pipe, combining the advantages provided by conventional threaded connections and by axial plug connections.

According to an advantageous feature of the present invention, a plug connection which—similar to a threaded connection—may be based on helical protrusions/grooves extending on a threaded connector and/or a corresponding threaded bushing having a circular cross-section, wherein the protrusions/grooves are constructed to prevent self locking which is common with a threaded connection.

A plug connection according to the invention for connecting two pipe sections of a drill pipe may thus include a connecting plug at one end of a first of the pipe sections and a connecting bushing on an end of a second of the pipe sections, wherein each of the connecting plug and the connecting bushing has at least one helical guide protrusion and/or guide groove which mesh when the plug connection is formed.

According to an advantageous feature of the present invention, to prevent the guide grooves from self-locking, their helical path may have a very large pitch, preferably in the range of 15° to 25° in relation to the longitudinal axis.

According to another advantageous feature of the present invention, the contact surfaces, via which the guide projections and/or guide grooves of the connecting plug and the connecting bushing, respectively, abut each other, may be oriented substantially radially, i.e., a straight line placed on the contact surface at an "arbitrary" location in the vertical direction to the longitudinal axis of the plug connection points substantially in the direction of this longitudinal axis. This design can prevent jamming of the thread flanks experienced by most threaded connections due to a radial deformation of the connecting parts caused by the radial force component produced by the geometry of the thread flanks. Advantageously, the guide projections have a rectangular or trapezoidal cross-section when viewed in cross-section perpendicular to the longitudinal axis of the plug connection. The employed materials for the contact surfaces of the connecting parts, the surface quality of the contact surfaces and possible use of a lubricant represent additional factors which may affect self-locking. These materials can be readily selected by a skilled artisan so as to prevent self-locking with the plug connection according to the invention.

The pitch of the helical path of the guide protrusions/guide grooves is an important design criterion and may advantageously be selected to be large enough so that the plug connection according to the invention can be produced exclusively by applying pressing forces (which are associated, of course, with a relative rotation of the two connecting parts)—even when materials typically for drill pipes are used, in particular steel, and even with a surface quality that does not require considerable fine-machining of the contact surface—.

However, a plug connection according to the invention may advantageously be formed separately by exclusively applying only torque, because the relative axial displacement is then forced by the helical guide protrusions/guide grooves—like in a threaded connection.

According to an advantageous feature of the present invention, due to the absence of self-locking, the plug connection according to the invention may be readily formed and released again (optionally manually)—like the conventional axial plug connection—by applying only axial forces (pressing or pulling forces in the direction of the longitudinal axis of the plug connection). It is then no longer necessary to use a mechanical release tool, which is required for screw connection. In addition, due to the helical shape of the guide projections/guide grooves, the plug connections may be secured automatically, as long as a torque (in the joining direction) is transmitted. Unlike with the conventional axial plug connection, the individual pipe sections of the drill pipe are securely held together, when pulling forces are applied, for example when the drill pipe is retracted.

According to yet another advantageous feature of the present invention, the connecting plug and/or the connecting bushing may have a conical insertion section for correcting poor coaxial alignment of the two connecting parts before they are plugged together. This can simplify the process of mechanically connecting the connecting parts of the plug connection according to the invention.

In addition, (at least) one seal may advantageously be provided which, when the plug connection is plugged together, seals an annular space formed between the connecting plug and the connecting bushing. Such seal can prevent contamination of the contact surfaces of the connecting parts, for example by a drilling fluid entering through the annular space.

According to an advantageous feature of the present invention, the pipe section according to the invention may be used as an inner pipe section of a double pipe section according to the invention of a double drill pipe, wherein the double pipe section additionally includes an outer pipe section surrounding the inner pipe section.

According to an advantageous feature of the present invention, the pipe section according to the invention may include additionally at least one cylindrical bearing seat for receiving a bearing ring. This bearing seat may advantageously receive a rotary bearing supporting the pipe section according to the invention in the outer pipe section, if this pipe section is arranged as an inner pipe section of a double pipe section.

According to an advantageous feature of the present invention, an annular space, which may be used, for example, for transporting a drilling fluid, may be provided between the outer pipe section and the valve section of the double pipe section according to the invention. This annular space may be at least partially closed off by the rotary bearing, thus obstructing transport of the drilling fluid. To prevent this, the bearing seat of the (inner) pipe section according to the invention may include at least one channel (in the longitudinal direction) crossing under the bearing seat.

According to an advantageous feature of the present invention, to enable transmission of electric energy and electric signals, for example from/to sensors arranged in a drill head connected with the drill pipe, a signaling line section may be routed inside the pipe section base body, the connecting plug and the connecting bushing of the (inner) pipe section according to the invention. This signaling line section may be, for example, an (electrically insulating) cable. Alternatively, an electrically conducting (bending-resistant) rod may be employed, as long as this rod is electrically insulated from the pipe section base body, the connecting plug and the connecting bushing.

According to an advantageous feature of the present invention, the two ends of the signaling line may each include a coupling part allowing connection with a corresponding coupling part of a signaling line section of a second pipe section to be connected with the first pipe section. For example, these coupling parts may be constructed as an axial plug connection, which can then also be automatically connected with each other when the two pipe sections are connected. To this end, the signaling line may be axially braced at least in the region of the coupling parts.

According to another advantageous feature of the present invention, the bearing of the inner pipe section in the outer pipe section may be secured against axial displacement. In this way, the assembly formed of the inner pipe section and the outer pipe section can be coupled with each other in a single coupling operation.

According to an advantageous feature of the present invention, the outer pipe sections of two double pipe sections to be connected may be connected by a screw connection, wherein each of the outer pipe sections has at one of the (longitudinal axial) ends a threaded plug and at the other end a corresponding threaded sleeve. The corresponding inner pipe sections constructed with a plug connection according to the invention can then be connected simultaneously and automatically while the axial displacement takes place.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
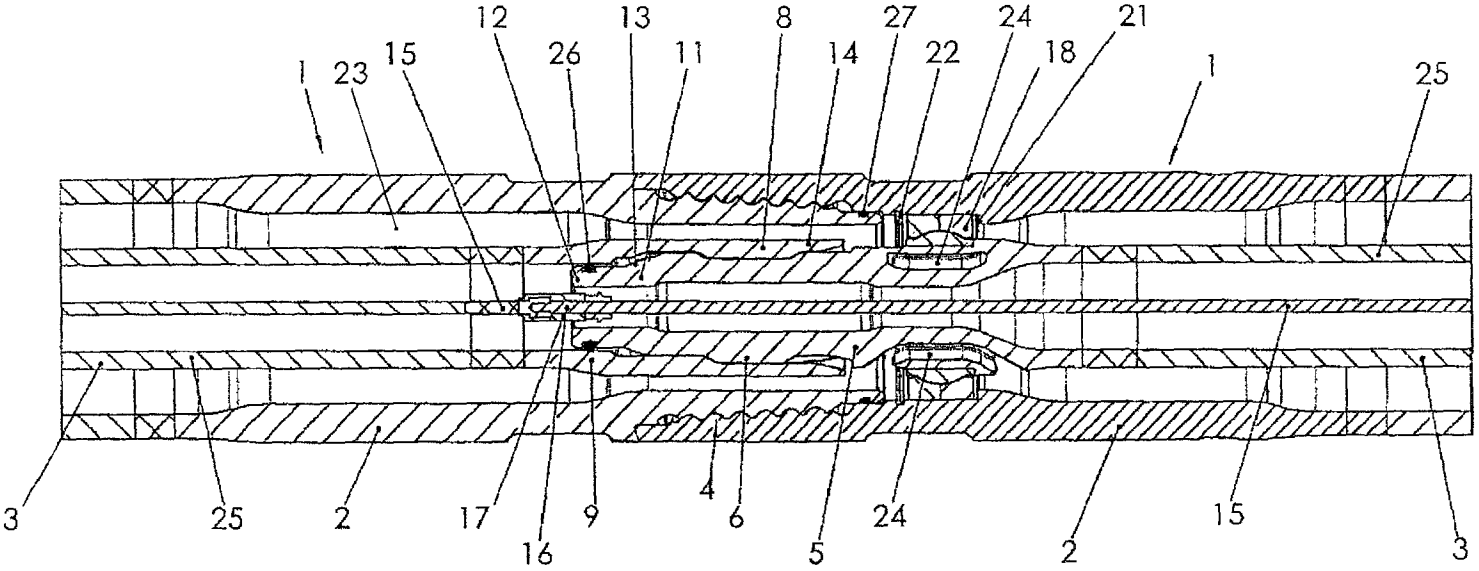
FIG. 1 a cross-sectional view, a detail of two interconnected pipe sections of a double drill pipe according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there are shown in cross-section two interconnected ends of double pipe sections 1 according to the invention of a double drill pipe. Each of the double pipe sections 1 includes an outer pipe section 2 and an inner pipe section 3 arranged centrally inside the outer pipe section 2. The actual shape of the employed threads and the sections of the pipe sections having this thread is described, for example, in the published US Patent Application 2011/0168286 A1 (application Ser. No. 13/063,663), the entire content of which is incorporated herein by reference.

Each of the outer pipe sections 2 has at one of its ends a conical outside thread and at the opposing end a corresponding conical inner thread for forming a threaded connection 4. These threaded parts are used to interconnect the individual outer pipe sections 2 with each other.

The two inner pipe sections are connected by way of the plug connection according to the invention. To this end, each of the inner pipe sections 3 has at one of its ends a connecting plug 5 with helical guide protrusions 6 (see FIG. 3), between which correspondingly shaped guide grooves 7 are formed. When the plug connection is formed, the guide protrusions 6 of the connecting plug 5 cooperate with the corresponding guide projections 8 of a connecting bushing 9 of the adjacent inner pipe section, i.e. they engage in the guide grooves formed by the guide projections 8. With the helical path of the guide projections 6, 8, the plug-in movement combines both a relative axial displacement and a relative rotation of the two connecting parts (connecting plug 5 and connecting bushing 9).

Figure 3:
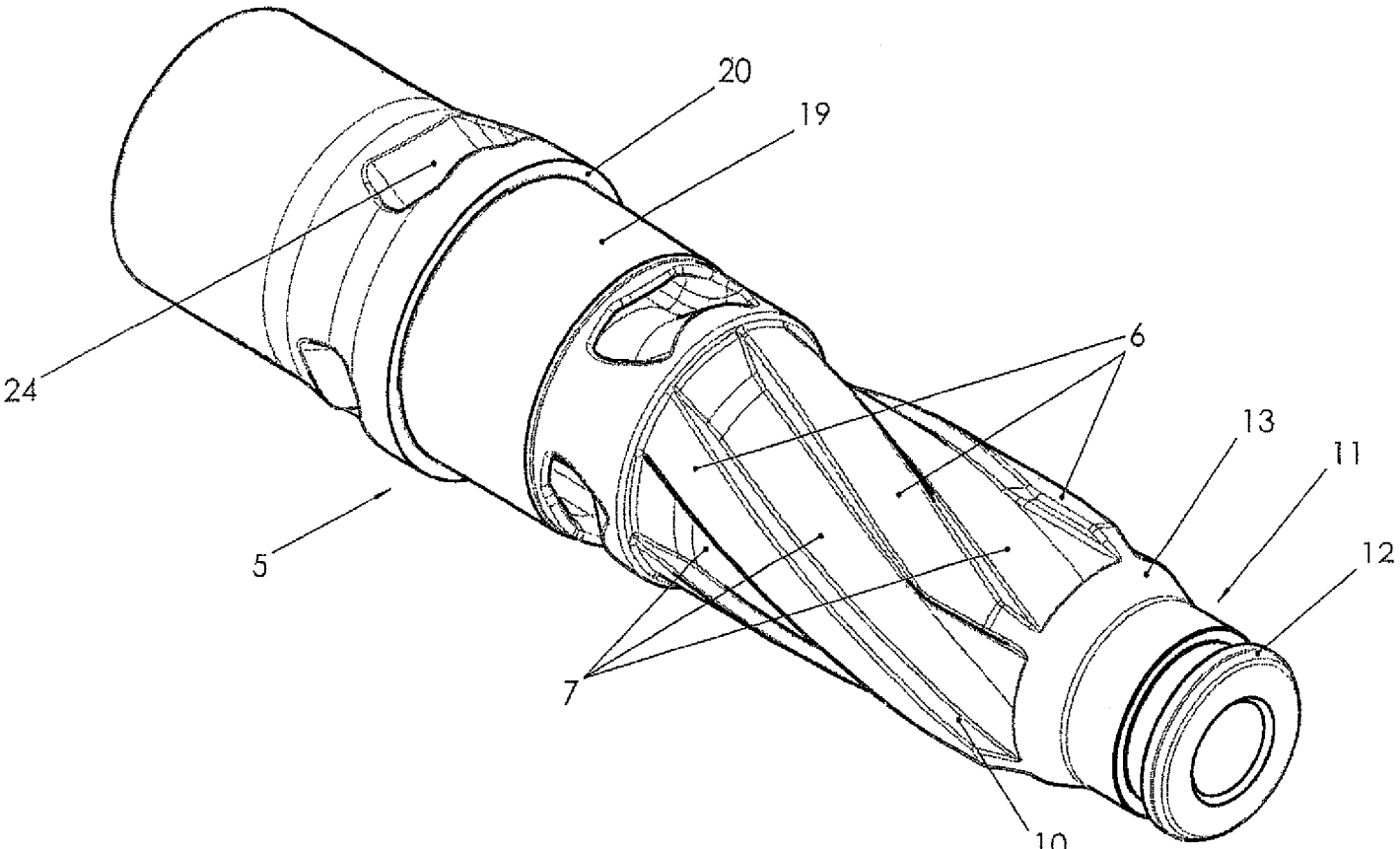
FIG. 3 the connecting plug of the plug connection of the double drill pipe according to FIG. 1 for connecting the inner pipe sections, in an isometric view.

As illustrated in particular in FIG. 3, the path of the helical guide protrusions 6, 8 has a very large pitch. In actuality, each of the guide protrusions 6, 8 extends only approximately 70° around the longitudinal axis over the entire length of the section of the connecting plug and/or of the connecting bushing receiving the guide protrusions. In addition, the flanks 10 of the guide protrusions 6, 8, which form contact surfaces for a contact with the corresponding guide protrusions 6, 8 of the other connecting part, are oriented substantially radially. The guide protrusions 6, 8 would hence have a rectangular cross-section—if the twist caused by the helical path were neglected. Self-locking of the plug connection according to the invention can be prevented in particular by these design features (large pitch, radial orientation of the contact surfaces 10), so that the plug connections can be engaged and disengaged by applying only axial forces.

The connecting plug 5 has at its front end an insertion section 11 with a smaller diameter, i.e., a smaller outside diameter than the other sections of the inner drill pipe. Moreover, the insertion section 11 of the connecting plug has two conical partial sections 12, 13. In conjunction with a conical insertion section 14 of the connecting bushing 9, the plug connection can be securely engaged with the insertion section 11 of the connecting plug 5 even when the two connecting parts are not precisely coaxially aligned with each other.

The inner pipe sections 3 are hollow and hence formed as tubular rod sections. A signaling line section 15 formed from a fixed (metal) wire is centrally arranged in each of the inner pipe sections 3 and held in this position (also in the axial direction) by (unillustrated) supports which are constructed to provide electric isolation. Each of these signaling line sections 15 has at one of its ends a plug 16 and at the corresponding other end a bushing 17 for forming an axial plug connection. The plug connection of the signaling line sections 15 is formed at the same time as the double pipe sections 1 of the double drill pipe are connected.

Each of the inner pipe sections 3 is rotatably supported in the corresponding outer pipe section 2 by a slide bearing ring 18. To this end, each of the inner pipe sections 3 has in the region of the connecting plug 5 a cylindrical bearing surface 19 for receiving the inner ring of the slide bearing ring 18. The bearing surface 19 is delimited towards one side by a shoulder 20 forming an axial stop for the slide bearing ring 18. The slide bearing ring 18 is (frictionally) joined with the inner pipe section 3 by a shrink-fit. The inside of each of the outer pipe sections 2 has likewise a corresponding bearing surface which contacts an outer ring of the slide bearing ring 18. This bearing surface is also delimited on one side by a shoulder 21 which in turn operates as a (first) axial stop for the slide bearing ring 18. A second axial stop is formed by a snap ring 22 which engages in a corresponding groove disposed on the inside of the outer pipe section 2. The slide bearing ring 18 is supported in the outer pipe section 2 with play, facilitating installation and uninstallation of the slide bearing ring 18 and the inner pipe section 3 connected thereto (for example for maintenance work). For this purpose, only the snap ring 22 needs to be removed before the inner pipe section 3 (which is only supported by the one slide bearing ring) is pulled out of the outer pipe section 2.

Figure 2:
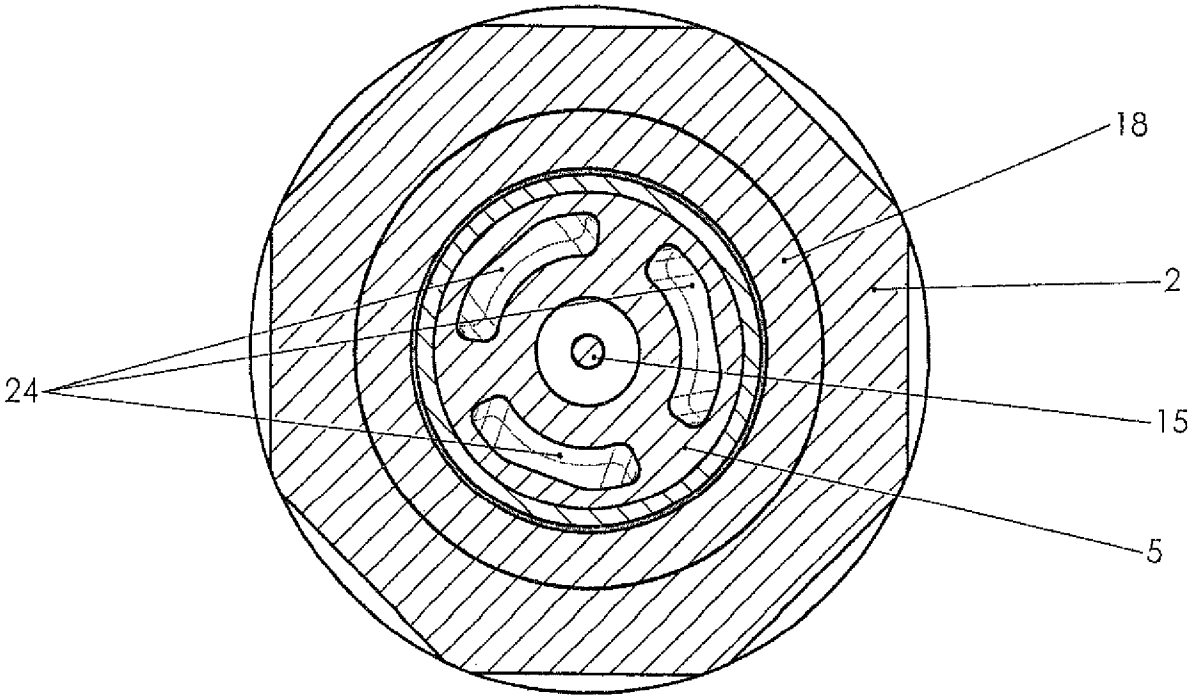
FIG. 2 a cross-sectional view taken along the intersecting plane II-II in FIG. 1.

An annular space 23 through which a drilling fluid is to be transported is formed between the inner wall of each of the outer pipe sections 2 and the outer wall of the corresponding inner pipe section 3. This annular space 23 is (at least partially) blocked in the region where the inner pipe section 3 is supported in the outer pipe section 2, providing altogether three channels 24 for transporting the drilling fluid. The channels 24 are integrated in the wall of the inner pipe section 3 and crosses under the bearing surface 19 and hence the slide bearing ring 18 in the longitudinal-axial direction, as is shown with particularity in FIGS. 2 and 3.

Due to the geometric complexity of the connecting parts of the plug connection of the inner pipe, the connecting parts may be produced as cast metal parts which are then welded or otherwise connected to the inner pipe base bodies 25 (made from metal and in particular steel) provided as a tubular semifinished product.

To prevent drilling fluid from entering the threaded connections of the outer pipe and the inner space of the inner pipe, the threaded connections and the plug connections of the inner pipe each have a corresponding seal 26, 27 in form of conventional O-rings, which are positioned in corresponding grooves of the threaded plug or connecting plug 5.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A plug connection for connecting two pipe sections of a drill pipe, comprising:

a connecting plug disposed on one end of a first of the two pipe sections and comprising:

one of a helical guide protrusion or a guide groove, a bearing surface defined radially about an exterior of the connecting plug for supporting a bearing ring, a shoulder delimiting the bearing surface on one end thereof and forming an axial stop for the bearing ring, and a channel for transporting a drilling fluid, the channel defined between first and second openings arranged on an exterior circumference of the connecting plug and passing through a portion of an interior of the connecting plug, the first opening being spaced apart from the second opening in an axial direction of the connecting plug, and a connecting bushing disposed on one end of the second pipe section and comprising one of a guide groove or a helical guide protrusion meshing with the helical guide protrusion or guide groove of the connecting plug.

2. The plug connection of claim 1, wherein the guide protrusions and the guide grooves comprise substantially radially oriented contact surfaces.

3. The plug connection of claim 1, wherein at least one of the connecting plug and the connecting bushing comprises an at least partially conically shaped insertion section.

4. The plug connection of claim 1, further comprising a seal which seals, when the plug connection is formed, an annular gap disposed between the connecting plug and the connecting bushing.

5. A pipe section for a drill pipe comprising:

a pipe section base body having two ends, a connecting plug disposed on a first longitudinal-axial end of the pipe section base body and comprising:

one of a guide protrusion or a guide groove, and a channel for transporting a drilling fluid, the channel defined between first and second openings arranged on an exterior circumference of the connecting plug and passing through a portion of an interior of the connecting plug, the first opening being spaced apart from the second opening in an axial direction of the connecting plug, and a connecting bushing disposed on a second longitudinal-axial end and comprising one of a guide groove or a guide protrusion constructed to mesh with the guide protrusion or guide groove of a connecting plug disposed on a pipe section base body of a second pipe section.

6. The pipe section of claim 5, further comprising a cylindrical bearing surface receiving a bearing ring.

7. The pipe section of claim 6, wherein the channel crosses under the bearing surface in the axial direction of the pipe section.

8. The pipe section of claim 5, further comprising a signaling line section routed inside the pipe section base body, the connecting plug and the connecting bushing.

9. The pipe section of claim 8, wherein the signaling line section has two ends, each end comprising a coupling member constructed for coupling with a corresponding connecting member of a signaling line section of a second pipe section.

10. The pipe section of claim 9, wherein the coupling members are constructed in form of an axial plug connection.

11. The pipe section of claim 8, wherein the signaling line section is axially braced.

12. The pipe section of claim 5, wherein the one of a guide protrusion or a guide groove of the connecting plug comprises one of a helical guide protrusion or a helical guide groove, and wherein the one of a guide groove or a guide protrusion of the connecting bushing comprises one of a helical guide groove or a helical guide protrusion.

13. A double pipe section for a double drill pipe comprising:

an outer pipe section and an inner pipe section arranged inside the outer pipe section, wherein the inner pipe section comprises a pipe section base body having two ends, with a connecting plug disposed on a first longitudinal-axial end of the pipe section base body and comprising one of a helical guide protrusion or a guide groove, and a connecting bushing disposed on a second longitudinal-axial end and comprising one of a guide groove or a helical guide protrusion constructed to mesh with the helical guide protrusion or guide groove of a connecting plug disposed on a pipe section base body of a second inner pipe section, wherein the connecting plug comprises a channel for transporting a drilling fluid, the channel defined between first and second openings arranged on an exterior circumference of the connecting plug and passing through a portion of an interior of the connecting plug, the first opening being spaced apart from the second opening in an axial direction of the connecting plug.

14. The double pipe section of claim 13, wherein the inner pipe section is supported in the outer pipe section by at least one rotary bearing.

15. The double pipe section of claim 14, wherein the at least one rotary bearing prevents axial displacement of the inner pipe section relative to the outer pipe section.

16. The double pipe section of claim 14, wherein the outer pipe section comprises a bearing surface delimited on one side thereof by a shoulder for supporting the at least one rotatory bearing.

17. The double pipe section of claim 13, wherein the outer pipe section comprises a threaded plug disposed on the first longitudinal-axial end and a corresponding threaded bushing disposed on the second longitudinal-axial end.

* * * * *